US007021630B1

(12) United States Patent
Cho

(10) Patent No.: US 7,021,630 B1
(45) Date of Patent: Apr. 4, 2006

(54) PORTABLE BALL RETRIEVER

(76) Inventor: Kwang Han Cho, 148 S. Gramercy Pl. #16, Los Angeles, CA (US) 90004

( * ) Notice: Subject to any disclaimer, the term of this patent is extended or adjusted under 35 U.S.C. 154(b) by 0 days.

(21) Appl. No.: 10/906,197

(22) Filed: Feb. 8, 2005

(51) Int. Cl.
*A63B 63/00* (2006.01)

(52) U.S. Cl. ..... 273/401; 473/197; 473/454; 473/478

(58) Field of Classification Search ..... 273/398–402, 273/395, 396; 473/476, 478, 434, 435, 454, 473/456
See application file for complete search history.

(56) References Cited

U.S. PATENT DOCUMENTS

| | | | | |
|---|---|---|---|---|
| 3,558,140 | A * | 1/1971 | Romeo | 473/164 |
| 5,088,740 | A * | 2/1992 | Peterson | 273/410 |
| 5,527,032 | A * | 6/1996 | Coleman et al. | 473/439 |
| D403,386 | S | 12/1998 | Cho | |
| 5,976,023 | A | 11/1999 | Cho | |
| D418,883 | S | 1/2000 | Cho | |
| 6,135,894 | A | 10/2000 | Cho | |
| 6,165,085 | A * | 12/2000 | Lubin | 473/478 |
| D441,040 | S | 4/2001 | Cho | |
| 6,312,343 | B1 | 11/2001 | Cho | |
| 6,514,149 | B1 * | 2/2003 | Yoon | 473/197 |
| 6,517,444 | B1 * | 2/2003 | Yoon | 473/197 |
| 6,554,717 | B1 | 4/2003 | Cho | |
| 2001/0034271 | A1 * | 10/2001 | Nozato | 473/197 |
| 2003/0203775 | A1 | 10/2003 | Wong | |
| 2003/0224866 | A1 * | 12/2003 | Chen | 473/197 |
| 2005/0200079 | A1 * | 9/2005 | Barber | 273/400 |

* cited by examiner

*Primary Examiner*—Mark S. Graham
(74) *Attorney, Agent, or Firm*—Park Law Firm; John K. Park

(57) ABSTRACT

A portable ball retriever comprises a first member forming a first closed loop, a second member forming a second closed loop with the first member foldably attached to the second member, supports fitted between the first and second members to sustain the first member against the second member, a fabric cover attached to the first member to substantially cover the first closed loop with a central portion of the cover severed along a line to secure a first opening and a drapery corresponding to the first opening, a fabric catch partially attached to the fabric cover to communicate with the first opening, and straps connecting a rear portion of the fabric catch to the second member.

20 Claims, 3 Drawing Sheets

PORTABLE BALL RETRIEVER

BACKGROUND OF THE INVENTION

This invention relates to an athletic ball retrieving net. More specifically, the present invention relates to an improved portable ball retriever provided with straps stabilizing a fabric ball catch that stops and releases a ball thrown from in front of the retriever.

Conventional athletic ball game nets typically focus on catching balls to facilitate ball games in a limited area. For example, a portable ball net is used indoors to catch a chip shot for golf practice.

A demand is to stabilize the ball catching net to observe shock from the ball catching so as to enhance ball recollecting characteristics. What is desperately required is to enable the ball catching net to stand robust against the ball thrown thereat while stopping and releasing the ball in a reliable manner.

Another demand on the market is to provide a practice net that enables a ball pitching practice using, for example, a baseball. Such a market demand can be satisfied if a ball thrown off from a pitcher can be stably stopped and easily retrieved. Further, when in a baseball pitching practice if the person throwing a ball can easily retrieve the ball around the net, it would be a significant advantage to those that still want to practice a ball throwing game alone in a place like a backyard or a patio.

SUMMARY OF THE INVENTION

The present invention is contrived to overcome the conventional disadvantages. Accordingly, it is an object of the present invention to provide a portable ball retriever enhancing ball recollecting characteristics by applying a strap tying mechanism between a first member placed on the ground and a ball catch that stops and retrieves the ball thrown thereto.

Another object is to stabilize the ball retriever by employing a collapsible net mechanism to enable overlapping loops in disassembly, and pop-up setting in assembly.

A further object is to enable a person throwing a ball for practice to easily retrieve the thrown ball near the retriever.

To achieve these and other objects, the portable ball retriever according to the present invention comprises: a first member forming a first closed loop, a second member forming a second closed loop, wherein the first member is foldably attached to the second member. Supports fitted between the first and second members are provided to sustain the first member against the second member while maintaining a substantial angle between the first member and the second member. A fabric cover is attached to the first member to substantially cover the first closed loop where a central portion of the cover is severed along a predetermined line to secure a first opening and a drapery corresponding to the first opening.

A fabric catch is partially attached to the fabric cover to communicate with the first opening so as to stop and release a ball thrown through the first opening where the fabric catch is substantially sagged toward the second member. In this construction, there are provided straps connecting a rear portion of the fabric catch to the second member.

In an embodiment, fabric retainers are provided to each have a support sleeve to receive the support and attachedly sided to the first and second members. It is preferred that the first and second members are each coilable to overlapping loops to facilitate a pop-up assembly, coiled disassembly and carriage of the ball retriever. The straps are elastic or each detachably attached from about a rear corner of the second member to the rear portion of the fabric catch. The fabric catch is shaped in a pouch. The first cover has a second opening below the first opening so that a ball stopped by and released from the ball catch can be easily retrieved through the second opening.

For a better performance, the ball retriever further comprises a first sleeve substantially covering the first member, a second sleeve substantially covering the second member, and a plurality of patches selectively attached to the first and second members to maintain the first and second members in a polygonal shape. The first sleeve has first holes and the second sleeve has second holes, wherein the first and second holes removably carry therein ends of the supports. The supports are a pair of rods whose ends become removably, correspondingly carried in the first and second base holes. The rods are elastically detachable to two pieces which remain connected by an elastic string provided in the respective rods.

The advantages of the present invention are numerous. Most of all, the rear portion of the fabric ball catch of the ball retriever is stably pulled by the straps toward each rear corner of the second member so as to straighten the fabric catch shaped in a pouch while balancing the pulling between the fabric catch and the second member against the sustaining of the supports between the first and second member, thereby enhancing utility and marketability. Further, the pair of coilable first and second members are foldably connected to each other and coilably overlapped in multiple loops, respectively, thereby further facilitating storage, assembly and disassembly of the ball retriever, thereby improving product reliability. In addition, the fabric retainers are each provided to have the support sleeve to receive the support therethrough which becomes attachedly sided to the first and second members for maximizing the propping property, thereby further stabilizing the posture of the ball retriever.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
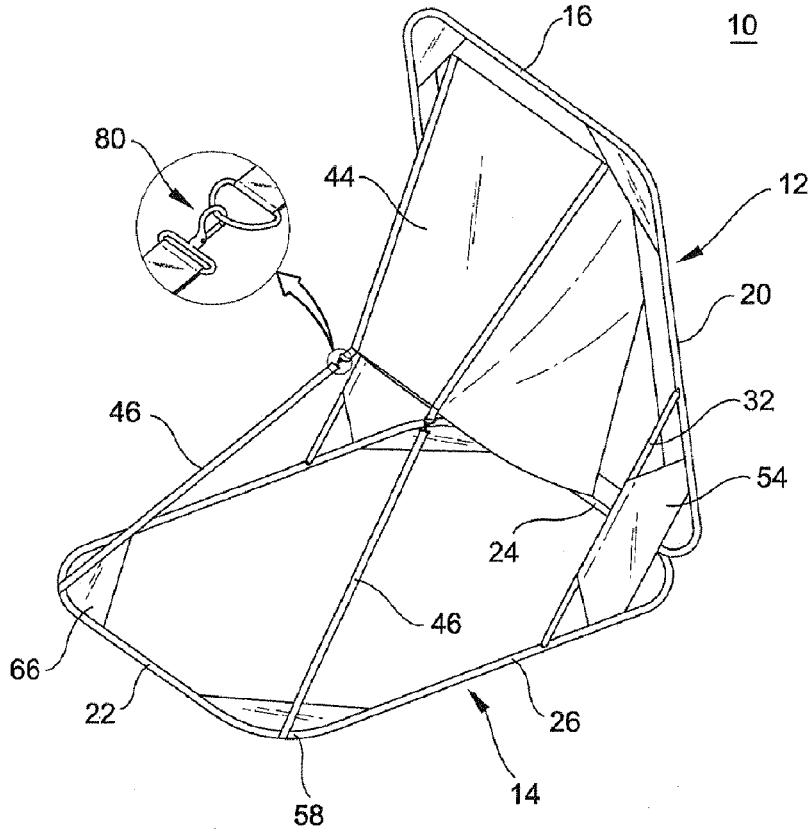
FIG. 1 is a perspective view illustrating a portable ball retriever according to the present invention.
Figure 2:
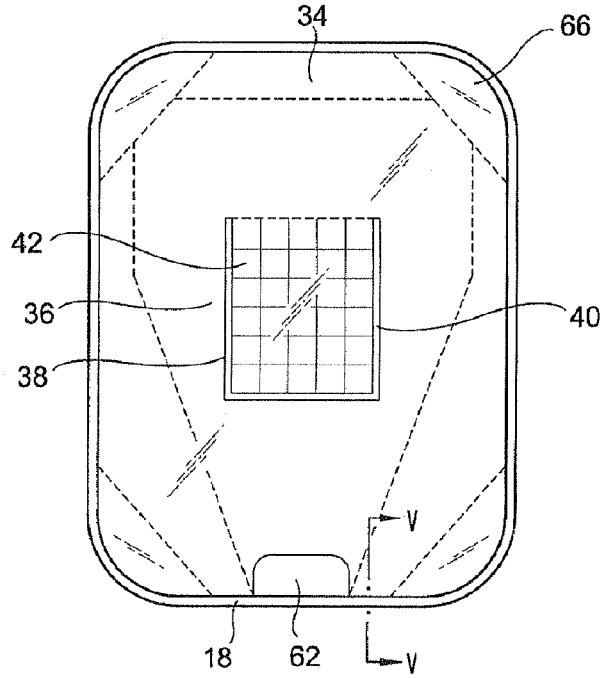
FIG. 2 is a front view of FIG. 1.
Figure 3:
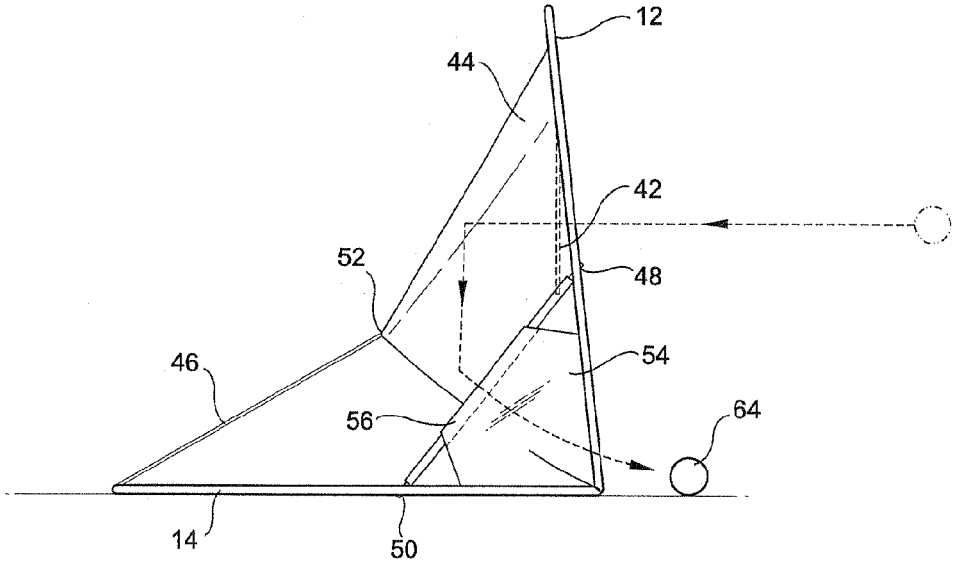
FIG. 3 is a side view of FIG. 1.

FIGS. 1–3 each show a portable ball retriever 10 according to the present invention in a perspective view, a front view and side view. As shown therein, the portable ball retriever 10 comprises a first member 12 forming a first closed loop 13, and a second member 14 forming a second closed loop 15. The first member 12 is foldably attached to the second member 14. In order to match with the first member 12, the second member 14 is provided to form the second closed loop 15 in a substantially similar format to the first member 12.

The first member 12 is defined by top, bottom and side sections 16, 18, 20, and the second member 14 is defined by rear, front and side sections 22, 24, 26. In this construction, the first member bottom section 18 is attached to the second member front section 24 so that the first member 12 can be angularly raised against the second member 14 while maintaining a partial attachment of the first and second members 12, 14.

Figure 5:
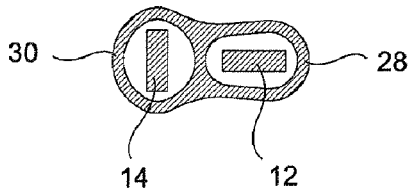
FIG. 5 is a cross-sectional view taken along line V—V in FIG. 2.

Meanwhile, FIG. 5 shows a cross-section taken along V—V in FIG. 2. As wherein therein, the first and second members 12, 14 are each fabric-covered so that the first member 12 is carried in a first sleeve 28, and the second member 14 is carried in the second sleeve 30. Specifically, the first sleeve 28 substantially covers the first member 12, and the second sleeve 30 substantially covers the second member 14. Here, the first sleeve 28 has first holes 48 and the second sleeve 30 has second holes 50.

In order to stably maintain a predetermined angle between the first member 12 and the second member 14 there are provided supports 32 in elongate format so that the supports 32 can be fitted between the first and second members 12, 14 to sustain the first member 12 against the second member 14 while maintaining a substantial angle between the first member 12 and the second member 14.

For a better performance, a fabric cover 34 is attached to the first member 12 to substantially cover the first closed loop 13 so that a central portion 36 of the cover 34 is severed along a predetermined line 38 to secure a first opening 40 and a drapery 42 corresponding to the first opening 40.

In this construction, a fabric catch 44 is partially attached to the fabric cover 34 to communicate with the first opening 40 so as to stop and release a ball thrown through the first opening 40. Here, the fabric catch 44 is substantially sagged toward the second member 14. The fabric catch 44 may be preferable shaped in a pouch.

To enhance product characteristic, there are provided straps 46 to connect a rear portion 52 of the fabric catch 44 to the second member 14. The ball retriever of claim 1 wherein the straps are elastic. It is preferred that the straps 46 become each detachably attached from about a rear corner 58 of the second member 14 to the rear portion 52 of the fabric catch 44.

Figure 4:
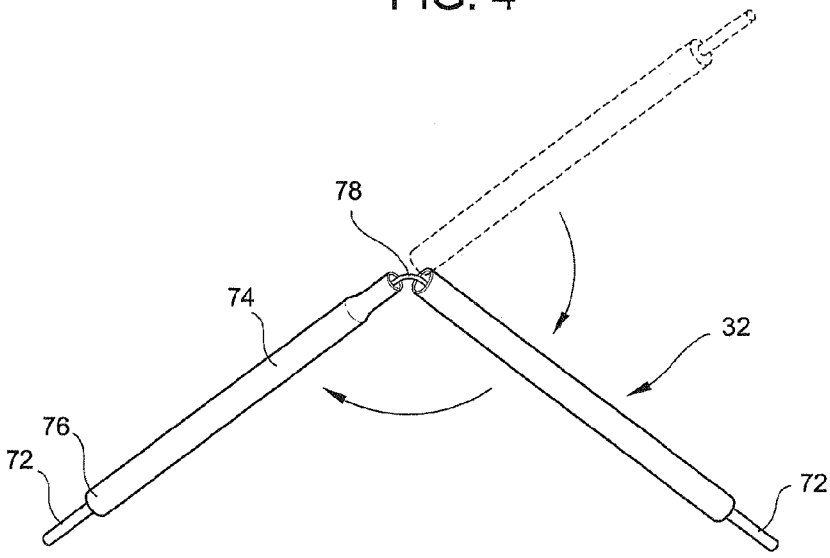
FIG. 4 is a construction view showing a support in FIG. 1.

As shown in FIG. 4, in order to reinforce propping of the supports 32 against the first and second members 12, 14, the ball retriever 10 further comprises fabric retainers 54 each in a patch format to have a support sleeve 56 that receives the support 32 therethrough. The fabric retainers 54 is attachedly sided to the first and second members 12, 14 so as to further stabilize the posture of the ball retriever.

Specifically, together with the supports 32 the fabric retainers 54 serve to secure a desired angle between the first and second members 12, 14 while enhancing stability of the raised-up posture of the first member 12 against the second member 14. Whereas, the first and second sleeves 28, 30 that allow passage of the supports 32 are to provide an additional stability to the supports 32. With the fabric retainer 54 provided in the ball retriever 10, the preferred angle by the first and second member 12, 14 is between about 50 degrees and slightly less than 90 degrees so that the first and second members 12, 14 can be maintained at a substantially erected.

In this mechanism, the first member 12 has a plurality of corners each in arc so as to shape the first closed loop 13 in a substantial polygon, and the second member 14 has a plurality of corners each in arc so as to shape the second closed loop 15 in a substantial polygon. To realize each polygonal formation of the first and second members 12, 14 the ball retriever 10 comprises the fabric retainer 54 formed adjacent to each of the corners so as to maintain the polygon in shape. The best mode of the polygonal formation is a substantial square format.

To improve portability of the ball retriever 10, the first and second members 12, 14 are each coilable to overlapping loops 60 to facilitate a pop-up assembly, coiled disassembly and carriage of the ball retriever 10. Meanwhile, the fabric cover 34 has a second opening 62 below the first opening 40 so that a ball 64 stopped by and released from the fabric catch 44 can be easily retrieved through the second opening 62.

In order to fabricate the fabric retainer 54 in non-circular shape when popped up or disassembled to start ball throwing practice, a plurality of patches 66 are selectively attached to the first and second members 12, 14 to maintain the first and second members in a polygonal shape.

In a preferred version, the first sleeve 28 has first holes 68 and the second sleeve 30 has second holes 70 so that the first and second holes 68, 70 removably carry therein ends 72 of the supports 32. For the convenience purpose, the supports 32 may be a pair of rods 74 whose ends 76 become removably, correspondingly carried in the first and second holes 68, 70. Here, the rods 74 are elastically detachable to two pieces which remain connected by an elastic string 78 provided in the respective rods 74. On the other hand, each fabric portions used in the ball retriever 10 may be formed of a material such as synthetic cloth or natural cloth.

For a better performance, the straps 46 is detachably attached by a hook 80 to the rear portion 52 of the fabric catch 44. The straps 46 are preferably elastic and formed of elastic material. In this construction, elasticity of the fabric straps 46 can be easily adjusted by hook control. For example, when the fabric catch 44 needs to be further pulled rearwardly and straightened, the hook 80 can be adjustably employed to improve the ball stopping and releasing characteristics.

Figure 6:
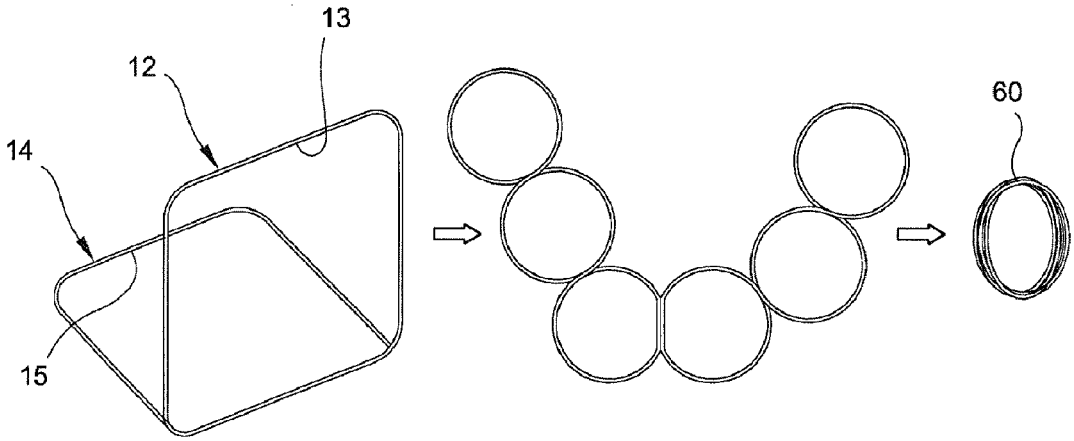
FIG. 6 is a schematic view showing a coiling mechanism of the portable ball retriever.

FIG. 6 shows a storage mechanism applied to the ball retriever 10. As shown therein, for better storage and dissembling purposes, the first and second members 12, 14 are each formed in a coilable format so that the first and second members 12, 14 are each coilable to overlapping loops 60. Preferably, the first and second members 12, 14 are each coiled in twofold or threefold to the overlapping loops 60 to facilitate storage and portability. For assembly into the usable ball retriever 10, the overlapped loops 60 can be simply released for elastic pop-up setting to the polygonal formation. Then, the first member 12 is raised and supported by the supports 32 selectively carried in the first and second sleeves 28, 30.

The first and second members 12, 14 may be formed of an elastic material so as to facilitate the assembly and the coiled overlapping for disassembly. For disassembly of the ball retriever 10, the supports 32 can be simply removed, and the first and second members 12, 14 are twisted and coiled into a plurality of overlapping loops 60. Accordingly, the pair of coiled first and second members 12, 14 can be easily stored in the storage bag (not shown).

As discussed above, an advantage of the present invention is that the rear portion 52 of the fabric ball catch 44 of the ball retriever 10 is stably pulled by the straps toward each rear corner 58 of the second member 14 so as to straighten the fabric catch 44 shaped in a pouch while balancing the pulling between the fabric catch 44 and the second member 14 against the sustaining of the supports 32 between the first and second member 12, 14, thereby enhancing utility and marketability.

Further, the pair of coilable first and second members 12, 14 are foldably connected to each other and coilably overlapped in multiple loops 60, respectively, thereby further facilitating storage, assembly and disassembly of the ball retriever 10, thereby improving product reliability. In addition, the fabric retainers 54 are each provided to have the support sleeve 56 to receive the support therethrough which becomes attachedly sided to the first and second members 12, 14 for maximizing the propping property, thereby further stabilizing the posture of the ball retriever 10.

Although the present invention has been described in considerable detail with reference to certain preferred versions thereof, other versions are possible by converting the aforementioned construction. Therefore, the scope of the invention shall not be limited by the specification specified above and the appended claims.

What is claimed is:

1. A portable ball retriever comprising:

a) a first member forming a first closed loop;

b) a second member forming a second closed loop, wherein the first member is foldably attached to the second member;

c) supports fitted between the first and second members to sustain the first member against the second member while maintaining a substantial angle between the first member and the second member;

d) a fabric cover attached to the first member to substantially cover the first closed loop, wherein a central portion of the cover is severed along a predetermined line to secure a first opening and a drapery corresponding to the first opening;

e) a fabric catch partially attached to the fabric cover to communicate with the first opening so as to stop and release a ball thrown through the first opening, wherein the fabric catch is substantially sagged toward the second member; and f) straps connecting a rear portion of the fabric catch to the second member.

2. The ball retriever of claim 1 wherein the first and second members are each coilable to overlapping loops to facilitate a pop-up assembly, coiled disassembly and carriage of the ball retriever.

3. The ball retriever of claim 1 wherein the straps are elastic.

4. The ball retriever of claim 1 wherein the straps are each detachably attached from about a rear corner of the second member to the rear portion of the fabric catch.

5. The ball retriever of claim 4 wherein the fabric catch is shaped in a pouch.

6. The ball retriever of claim 1 wherein the first cover has a second opening below the first opening so that a ball stopped by and released from the fabric catch can be easily retrieved through the second opening.

7. The ball retriever of claim 1 further comprising:

a) a first sleeve substantially covering the first member;

b) a second sleeve substantially covering the second member; and c) a plurality of patches selectively attached to the first and second members to maintain the first and second members in a polygonal shape.

8. The ball retriever of claim 7 wherein the first sleeve has first holes and the second sleeve has second holes, wherein the first and second holes removably carry therein ends of the supports.

9. The ball retriever of claim 8 wherein the supports are a pair of rods whose ends become removably, correspondingly carried in the first and second base holes.

10. The ball retriever of claim 9 wherein the rods are elastically detachable to two pieces which remain connected by an elastic string provided in the respective rods.

11. A portable ball retriever comprising:

a) a first member forming a first closed loop;

b) a second member forming a second closed loop, wherein the first member is foldably attached to the second member;

c) supports fitted between the first and second members to sustain the first member against the second member while maintaining a substantial angle between the first member and the second member;

d) fabric retainers each having a support sleeve to receive the support and attachedly sided to the first and second members;

e) a fabric cover attached to the first member to substantially cover the first closed loop, wherein a central portion of the cover is severed along a predetermined line to secure a first opening and a drapery corresponding to the first opening;

f) a fabric catch partially attached to the fabric cover to communicate with the first opening so as to stop and release a ball thrown through the opening, wherein the fabric catch is substantially sagged toward the second member; and g) straps connecting a rear portion of the fabric catch to the second member.

12. The ball retriever of claim 11 wherein the first and second members are each coilable to overlapping loops to facilitate a pop-up assembly, coiled disassembly and carriage of the ball retriever.

13. The ball retriever of claim 11 wherein the straps are elastic.

14. The ball retriever of claim 11 wherein the straps are each detachably attached from about a rear corner of the second member to the rear portion of the fabric catch.

15. The ball retriever of claim 14 wherein the fabric catch is shaped in a pouch.

16. The ball retriever of claim 11 wherein the fabric cover has a second opening below the first opening so that a ball stopped by and released from the fabric catch can be easily retrieved through the second opening.

17. The ball retriever of claim 11 further comprising:

a) a first sleeve substantially covering the first member;

b) a second sleeve substantially covering the second member; and c) a plurality of patches selectively attached to the first and second members to maintain the first and second members in a polygonal shape.

18. The ball retriever of claim 17 wherein the first sleeve has first holes and the second sleeve has second holes, wherein the first and second holes removably carry therein ends of the supports.

19. The ball retriever of claim 18 wherein the supports are a pair of rods whose ends become removably, correspondingly carried in the first and second base holes.

20. The ball retriever of claim 19 wherein the rods are elastically detachable to two pieces which remain connected by an elastic string provided in the respective rods.

* * * * *